US005215793A

United States Patent [19]

Osment et al.

[11] Patent Number: 5,215,793

[45] Date of Patent: Jun. 1, 1993

[54] ARTIFICIAL FOLIAGE AND METHOD OF FORMING SAME

[75] Inventors: David L. Osment; Dwayne Fulton, both of Osage Beach, Mo.

[73] Assignee: Osment Models, Inc., Linn Creek, Mo.

[21] Appl. No.: 595,103

[22] Filed: Oct. 10, 1990

Related U.S. Application Data

[63] Continuation-in-part of Ser. No. 425,057, Oct. 20, 1989, Pat. No. 5,019,431.

[51] Int. Cl.[5] ..... A41G 1/00

[52] U.S. Cl. ..... 428/18; 156/61

[58] Field of Search ..... 428/15, 17, 18, 19, 428/919; 156/61

[56] References Cited

U.S. PATENT DOCUMENTS

| | | | |
|---|---|---|---|
| 1,949,063 | 2/1934 | Merrill | 428/17 X |
| 2,811,906 | 11/1957 | Chappell | 428/48 X |
| 2,977,864 | 4/1961 | Pullar | 428/403 X |
| 2,978,351 | 4/1961 | Pullar | 428/403 |
| 3,471,419 | 10/1969 | Ehrlich | 156/61 X |
| 3,554,848 | 1/1971 | Dock | 428/15 |
| 4,082,586 | 4/1978 | Osment | 428/18 X |
| 4,196,239 | 4/1980 | Sawyer | 156/61 X |
| 4,202,922 | 5/1980 | Osment | 428/18 |
| 4,278,481 | 7/1981 | Osment | 428/18 X |
| 4,802,586 | 2/1989 | George | 206/449 X |
| 4,950,509 | 8/1990 | DeMott | 156/61 X |
| 5,019,431 | 5/1991 | Osment et al. | 428/17 X |

OTHER PUBLICATIONS

Pages 197 and 1211 of New Riverside University Dictionary The Riverside Publishing Company.

Page 114 of the Random House Dictionary of the English Language Second Edition Unabridged.

Page 125 of Webster's II New Riverside University Dictionary The Riverside Publishing Company.

The Title Page, the Verso of the Title Page and p. 48 of Webster's Seventh New Collegiate Dictionary-G.+C. Merriam Company, Publishers-Springfield, Mass., U.S.A.

*Primary Examiner*—Henry F. Epstein

[57] ABSTRACT

A method of forming artificial vegetation, and products formed by the method. Foam particles are adhesively combined to form a cohesive mass. This mass may be placed in a mold cavity and dried to form a final product, such as an artificial bush, when removed from the mold. The cohesive mass may alternatively be dried and shredded to form members, each of which includes a plurality of the foam particles. These members may also be used as a final product, such as an artificial bush. The members may alternatively be fixed to the limbs of an artificial tree trunk to form an artificial tree. The artificial tree trunk may be molded of plastic into an intermediate form which is then bent to the final form. Solvent may be applied to the plastic tree trunk to make it tacky for application of the foam members.

23 Claims, 1 Drawing Sheet

ARTIFICIAL FOLIAGE AND METHOD OF FORMING SAME

CROSS-REFERENCE TO RELATED APPLICATIONS

This application is a continuation-in-part of U.S. Ser. No. 07/425,057, filed Oct. 20, 1989, now U.S. Pat. No. 5,019,431 which is included herein by reference.

BACKGROUND OF THE INVENTION

1. Field of the Invention

The present invention is directed to scale-model artificial foliage for use in displays and representations, and a method of making such artificial foliage.

2. Description of the Related Art

Scale-model representations of Vegetation have been produced and used by hobbyists and professionals for a large number of years. Model railroads and architectural models are two typical applications for such artificial foliage.

Artificial trees used for architectural models have been constructed by first casting a trunk and limb structure and then stretching steel wool over the limbs. Granular material was then adhered to the steel wool to simulate the foliage. This method is costly and requires a fair amount of artistic ability to achieve a tree with a realistic appearance. Steel particles may also drop from the steel wool, making such trees unsuitable for use with electrified model railroad layouts.

A less expensive artificial tree which avoids the problem of ferrous particles has been disclosed in U.S. Pat. Nos. 4,082,586, 4,202,922 and 4,278,481. In these prior art arrangements, a trunk and limb structure is cast, but the limbs are covered with an easily produced, realistic and non-ferrous foliage-representing member. This member is formed of a fibrous integral substrate having foam particles adhered thereto which may be stretched over the limbs. While this arrangement was an improvement over the previous architectural models, the process was labor-intensive and was not sufficiently realistic for some purposes.

SUMMARY OF THE INVENTION

It is therefore an object of the present invention to provide a method of making artificial vegetation which is amenable to automation.

It is another object of the present invention to provide an artificial vegetation product having improved realism.

An important object of our invention is to provide an artificial vegetation product and method of making same wherein the foliage representing member is free of any supporting integral substrate.

It is also an aim of this invention to provide an artificial vegetation product and method of producing same which is adaptable to represent vegetation of greatly varying size, from ground cover to tall trees.

Still another objective of the invention is to provide an artificial vegetation product and method of making same wherein the foliage representing member is formed from a completely homogenous mass, which mass can be manipulated to present foliage of varying slopes, configurations, and densities.

These and other objects are achieved by the present method of forming artificial vegetation. In this method, foam particles are coated with an adhesive to form a cohesive mass. This mass is placed upon a forming substrate, and the adhesive allowed to dry to form a unitary homogenous mass of affixed particles. This unitary mass is then removed from the forming substrate to present stock for forming a foliage representing member that is completely integral substrate-free.

The forming substrate that is used to temporarily support the mass may be in the form of a mold cavity such that the unitary mass forms the completed product. In such a case the artificial vegetation will have the general form of the mold cavity and may resemble, for example, a bush. The individual particles of foam comprising the unitary mass will give the impression of individual leaves or clumps of leaves.

The unitary mass may also be an intermediate step in the process. A forming substrate shaped as a plate will result in the homogenous unitary mass taking the form of a slab. This slab may then be shredded to form small, irregularly-shaped masses of particles. Adhering a number of these small masses of particles to a trunk and limb structure provides a realistic representation of a tree.

BRIEF DESCRIPTION OF THE DRAWINGS

The invention is described in detail with reference to the accompanying drawings, in which.

DETAILED DESCRIPTION OF THE INVENTION

The particles used to represent foliage may be formed from a wide variety of materials, but a preferred starting material is a resilient foam such as latex or urethane foam, with flexible polyurethane foam being most preferred. The stock foam is first wet ground in a grinder to achieve particles of the desired size. Coloring the foam the desired color during the grinding by the addition of a Water-based pigment has been found to be expedient.

The foam is wet ground until the foam particles have reached sizes that will pass through a #3 mesh screen, but will not pass through a #100 mesh screen. Upon reaching the desired particle size, the foam may be dried. This may be effected by the use of a commercial dryer at a temperature of approximately 150° to 200° F. for about one hour. When the foam particles have been completely dried, they are subjected to a final sifting step to obtain particles having the desired range of sizes. Although the particle size range will vary with the particular application envisioned, sifting to obtain particles which will pass through a #8 mesh screen, but will not pass through a #24 mesh screen is typically adequate.

The foam particles are then formed into a single mass This is achieved by mixing the particles with an adhesive. The adhesive may be any of numerous types, including acrylics, vinyl acrylics, styrene acrylic copolymer, urethane and latex foam adhesives, and alcohol based cements. The adhesive is preferably water soluble, such as an acrylic polymer aqueous solution having a boiling point of 212° F., a melting point of 32° F., a specific gravity of between 1.0 to 1.2 and a vapor pressure of 17 mm Hg at 68° F. A product meeting these specifications is RHOPLEX B15J ®, sold by the Rohn & Haas Company of Philadelphia, Pa. This adhesive is diluted with 15-35% (preferably 25%) by volume of water and combined with the particles at a ratio of 8 to 16 ounces of adhesive solution per gallon of foam. The particles and adhesive solution are then mixed in a commercial mixer until all of the particles have been evenly covered with the solution to form a cohesive mass.

Figure 1:
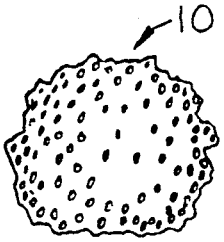
FIG. 1 is a plan view of a bush formed in accordance with the present invention.

This cohesive homogeneous mass is then dried upon a forming substrate. This drying can be used to form a final product, a portion of a final product, or an intermediate material. To form a final, or portion of a final product, the cohesive mass is placed within an appropriately shaped mold cavity (the forming substrate) for drying. This mold cavity may typically take the form of a sphere or hemisphere having irregularities or undulations on the surface thereof. When removed from such a mold as a unitary mass, the final product may be used alone as a bush 10, as shown in FIG. 1. The irregularities in the exterior of the product due to the mold irregularities improve realism, and the exterior particles provide irregularities on a smaller order of magnitude to further improve realism. It is noted that foam particles having larger sizes (on the order of 1 cm in average diameter) may be required in order to provide the desired amount of surface irregularity. Such sizes of foam particles are intended to be encompassed by the phrase "finely ground".

The unitary mass removed from the mold may alternatively be engaged with the limb and trunk structure of a model tree, and as such be a portion of a final product. In this case, distortion of the unitary mass due to the underlying limbs and trunk will be combined with the irregularities discussed above to provide a realistic scale-model tree.

Figure 2:
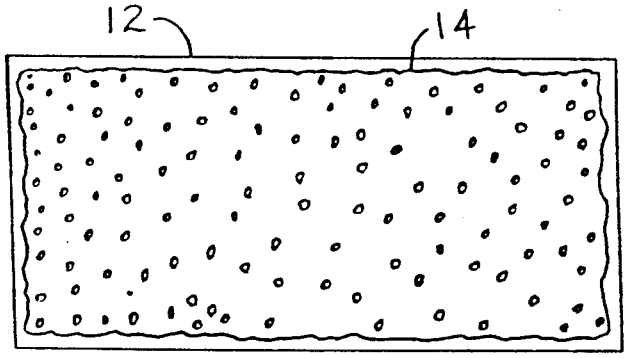
FIG. 2 is a top view of a slab of adhered particles used in the present invention.

With reference to FIG. 2, the forming substrate may also take the shape of a plate 12, with the cohesive mass 14 being spread out on the forming substrate to a roughly uniform depth. When dry, mass 14 may be used as an intermediate material as described below. However, it is first noted that drying of the unitary mass is preferably carried out at a temperature of between 100° to 500° F. until the water and adhesive in the adhesive solution are fully removed. The time required for drying will of course depend upon the materials employed, the amount of material and the forming substrate configuration.

Figure 4:
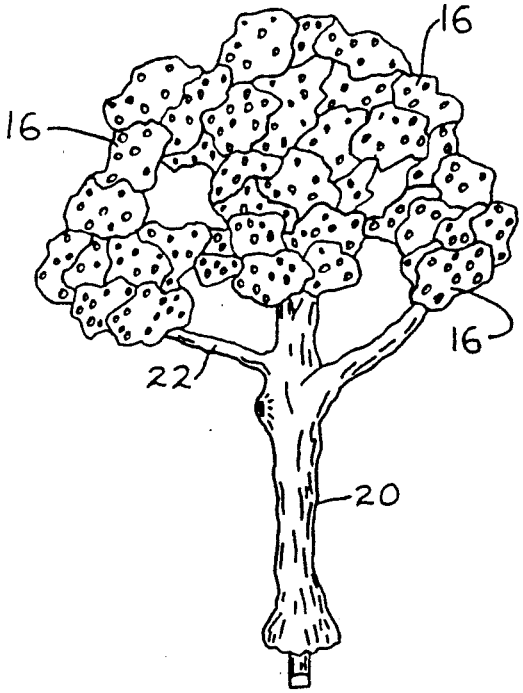
FIG. 4 is a side elevational view of a finished tree according to the present invention.

The cohesive mass 14 of FIG. 2 is removed from the forming substrate 12 as a unitary mass after drying. This unitary mass is then formed into smaller pieces by running the unitary mass through a commercial shredder or hammermill or other comminuting device. This results in the formation of relatively small members 16 (FIG. 4.) of irregular shape and size, with each of these members being formed of a plurality of the foam particles. As with the unitary masses formed using the irregular mold cavities, the comminution into small members produces irregular shapes, with the individual particles providing a smaller order of irregularities. These members 16 may be used as-is to represent foliage such as small bushes, or may be fixed to a trunk and limb structure as shown in FIG. 4. Prior to discussing the methods of forming the artificial tree of FIG. 4, however, the trunk and limb structure used in the methods will be described.

The trunk and limb structure may be of any type previously known. In its simplest form the trunk and limb structure may consist simply of an elongated trunk or body. It should be noted that "elongated" is intended as a relative term, as the body may be quite short for some scale-model representations. The body preferably has a plurality of limbs extending outwardly therefrom at points along at least a portion of the body.

Numerous materials may be used to form the trunk and limb structure, including wood, metal and plastic. A wooden trunk and limb structure would require labor-intensive carving to the appropriate shape, whereas metal and plastic could be cast or molded to a final or near-final form. The methods of forming the trunk and limb structure described in the above-noted U.S. Pat. Nos. 4,082,586, 4,202,922 and 4,278,481 may of course be advantageously utilized. A preferred method of forming the trunk and limb structure, however, involves molding a flexible plastic.

Figure 3:
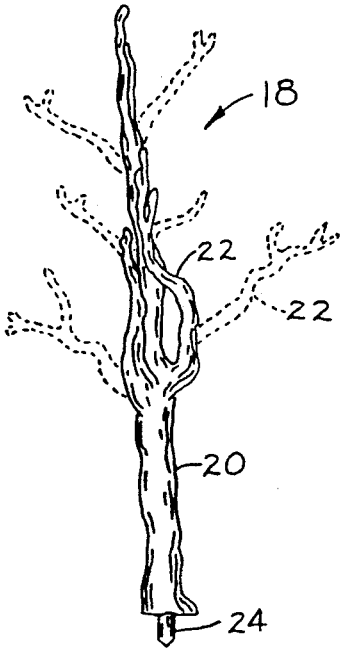
FIG. 3 is a side elevational view of a trunk and limb structure according to the present invention.

A trunk and limb structure formed by this preferred method is shown in FIG. 3 and generally designated by reference numeral 18. Trunk and limb structure 18 includes a trunk-representing body 20 and a plurality of limbs 22. The trunk and limb structure may also include a projection or stake 24 for mounting the finished tree to a supporting surface. Trunk and limb structure 18 is formed by molding, preferably injection molding, a flexible plastic such as Styrene ®, acrylonitrile-butadiene-styrene (ABS) or, preferably, K-Resin ® (a styrene-butadiene copolymer) produced by Phillips 66 Company.

The plastic may be molded to the final form of the trunk and limb structure or may be molded to an intermediated form as shown by the solid lines in FIG. 3. The intermediate form would then have portions thereof bent (i.e., plastically deformed) manually or mechanically to the final form. This deformation may be effected to the tines 22, body 20, or both. In FIG. 3 for example, the dashed lines indicate the limbs 22 after they have been bent from their initial, substantially vertical orientation to a more laterally extending orientation. If the trunk and limb structure was initially molded with the limbs substantially within a plane, as disclosed in U.S. Pat. Nos. 4,082,586, 4,202,922 and 4,278,481, bending of the body 20, between longitudinally spaced limbs, about its longitudinal axis will produce a three dimensional limb arrangement.

Once the trunk and limb structure is in its final form, the members 16 may be fixed to the trunk and limb structure. This fixing may be accomplished by several means. First, the members may be physically forced onto the limbs and upper end of the body, creating mechanical interference to maintain the members 16 in place. Second, an appropriate adhesive for the trunk and limb structure and members 16 may be applied to portions of the limbs and body. The members 16 may then be adhesively fixed to the trunk and limb structure. Finally, if the trunk and limb structure is formed of plastic, an appropriate solvent, such as methyl ethyl ketone, methylene dichloride, toluol or methylenechloride, may be applied to portions of the limbs and body to make those portions tacky. The members 16 may then be fixed to the trunk and limb structure by simply contacting the latter with the members.

Various methods are also available to place the members 16 into contact with the portions of the trunk and limb structure to which adhesive or solvent have been applied. The members may be individually placed manually, or the trunk and limb structure may be dipped into a container holding a supply of the members 16. The trunk and limb structure could also be tumbled in a container with a supply of the members 16. With any of these methods other than manual placement, care must be taken that members which have come into contact with the tacky portions are not subsequently removed by the forces generated by the application method. The appropriate choice of the adhesive or solvent application will result in a sufficiently tacky surface on the trunk and limb structure to minimize this problem.

A completed tree is shown in FIG. 4. It should be noted that the individual members 16 fixed to the trunk and limb structure combine to form a highly irregular surface generally in conformity with the limbs and body, resulting in a realistic appearance. In particular, the members 16 fixed to the trunk and limb structure extend outwardly from the limbs and body at various angles to give the impression of foliage on a complex system of branches, even with a simple limbs arrangement.

As a final step, a clear matt coating may be applied to the tree to increase durability. This may be effected by spraying the tree with a water base polymer having a flat finish and which remains pliable.

It should also be noted that color plays an important part in the realistic appearance of artificial vegetation. In the present invention the trunk and limb structure may be painted or formed from an appropriately colored plastic to give the impression of a tree trunk and limbs. As stated above, the foam particles are preferably dyed the appropriate color, usually a shade of green. To improve realism, foam particles dyed slightly different shades of green may be combined to form the cohesive mass which is then dried on the forming substrate. Additionally, members 16 applied to the trunk and limb structure may be formed of particles having different shades, different combinations of shades, or different ratios of the same set of shades.

It will be understood that certain features and subcombinations of the invention disclosed are of utility and may be employed without reference to other features and subcombinations. This is contemplated by and is within the scope of the claims.

Since many possible embodiments may be made of the invention without departing from the scope thereof, it is to be understood that the present invention is not limited to the embodiments particularly described herein, but is limited only by the scope of the claims.

What is claimed is:

1. A method of forming artificial vegetation for use in man made replications of natural landscapes, comprising the steps of:

providing a mass of finely ground particles;

providing a quantity of an adhesive solution characterized by the ability to bind said ground particles together;

mixing said adhesive solution and said ground particles together to thoroughly coat the particles with the adhesive solution thereby forming a homogeneous mass;

placing said homogeneous mass onto a molding surface;

drying said homogeneous mass to remove the adhesive solvent components of said solution and form at least one substrate-free foliage-representing member;

removing said foliage-representing member from said molding surface;

providing a trunk and limb representing structure; and fixing said at least one member to said trunk and limb representing structure to form said artificial vegetation.

2. A method as in claim 1, wherein said step of forming at least one foliage-representing member comprises forming a plurality of said foliage-representing members, and said fixing step comprises fixing said plurality of foliage-representing members to said trunk and limb representing structure at discrete locations on said trunk and limb representing structure.

3. A method as in claim 2, wherein said step of fixing said members to said trunk and limb representing structure comprises:

fixing each said member to at least one limb in said trunk and limb representing structure by mechanical interference.

4. A method as in claim 3, wherein said step of fixing said members to said trunk and limb representing structure comprises:

applying adhesive to portions of said at least one limb;

bringing said members into contact with said adhesive applied to said at least one limb; and allowing said adhesive to set to thereby fix each said member to said at least one limb.

5. A method as in claim 4, wherein said step of bring said members into contact comprises:

manually bringing said members into contact with said adhesive applied to said at least one limb.

6. A method as in claim 2, wherein said step of providing a trunk and limb representing structure comprises:

molding a plastic to form said trunk and limb representing structure with a plurality of limbs each extending outwardly from a trunk, each said limb having a free end; and wherein said step of fixing said members to said trunk and limb representing structure comprises:

fixing each said member to a respective one of said trunk or at least one of said limbs.

7. A method as in claim 6, wherein said step of fixing said members to said trunk and limb representing structure comprises:

applying a solvent for said plastic to portions of said trunk and limbs;

bringing said members into contact with said portions; and allowing said solvent to evaporate and said plastic to set to thereby fix each said member to a respective one of said trunk or one of said limbs.

8. A method as in claim 6, comprising, subsequent to said molding step and prior to said fixing step, the further step of:

plastically deforming at least one of said trunk or one of said limbs to a configuration other than as molded.

9. A method as in claim 1, wherein said step of providing a mass of particles comprises providing a plurality of resilient foam particles.

10. A method as in claim 9, further comprising the step of dyeing said particles prior to said mixing step.

11. A method as in claim 1, wherein said drying step comprises drying at 100–5000 for up to 8 hours.

12. A method as in claim 11, wherein said step of providing an adhesive solution comprises:

providing an adhesive characterized by the ability to bind said particles together and by the ability to be diluted with a solvent; and diluting said adhesive with said solvent to form an adhesive solution.

13. A method as in claim 12, wherein said step of providing particles comprises:

providing a mass of particles having sizes such that said particles will pass over a #24 mesh screen and pass through a #8 mesh screen.

14. A method as in claim 12, wherein said step of providing particles comprises:

providing a mass of finely ground urethane foam.

15. A method as in claim 14, wherein said step of providing an adhesive comprises:

providing a water emulsion of an acrylic polymer.

16. An artificial vegetation product, comprising:

a trunk and limb representing structure; and at least one substrate-free foliage representing member, each said at least one member comprising a plurality of particles affixed as a singular mass, said at least one member being fixed to said trunk and limb representing structure.

17. A product as in claim 16, wherein said at least one member comprises a plurality of said members, said members being fixed to said trunk and limb representing structure at discrete locations.

18. A product as in claim 17, wherein said particles are resilient foam.

19. A product as in claim 17, wherein said trunk and limb representing structure comprises a trunk having first and second ends and a plurality of limbs extending outwardly from said trunk at respective points on said trunk between said ends, each said limb having a free end.

20. A product as in claim 19, wherein said members are fixed to said trunk and limb representing structure by mechanical interference.

21. A product as in claim 19, wherein said members are fixed to said trunk and limb representing structure by an adhesive.

22. A product as in claim 19, wherein said trunk and limb representing structure is formed of a thermoplastic.

23. A product as in claim 22, wherein said thermoplastic is plastically deformable by the application of pressure.

* * * * *